US012523100B2

(12) United States Patent
Lund

(10) Patent No.: US 12,523,100 B2
(45) Date of Patent: Jan. 13, 2026

(54) BHA WITH ELECTRIC DIRECTIONAL DRILLING MOTOR

(71) Applicant: CONOCOPHILLIPS COMPANY, Houston, TX (US)

(72) Inventor: Hans-Jacob Lund, Houston, TX (US)

(73) Assignee: ConocoPhillips Company, Houston, TX (US)

( * ) Notice: Subject to any disclaimer, the term of this patent is extended or adjusted under 35 U.S.C. 154(b) by 128 days.

(21) Appl. No.: 18/470,145

(22) Filed: Sep. 19, 2023

(65) Prior Publication Data

US 2024/0117677 A1 Apr. 11, 2024

Related U.S. Application Data

(60) Provisional application No. 63/378,633, filed on Oct. 6, 2022.

(51) Int. Cl.

| | |
|---|---|
| ***E21B 4/04*** | (2006.01) |
| ***E21B 7/04*** | (2006.01) |
| ***E21B 7/06*** | (2006.01) |
| ***E21B 41/00*** | (2006.01) |
| ***E21B 47/06*** | (2012.01) |
| ***E21B 49/00*** | (2006.01) |

(52) U.S. Cl.
CPC ..... *E21B 4/04* (2013.01); *E21B 7/04* (2013.01); *E21B 47/06* (2013.01); *E21B 49/00* (2013.01)

(58) Field of Classification Search
CPC ..... E21B 4/04; E21B 7/06
See application file for complete search history.

(56) References Cited

U.S. PATENT DOCUMENTS

| | | | | |
|---|---|---|---|---|
| 6,092,610 | A | 7/2000 | Kosmala et al. | |
| 7,953,586 | B2 | 5/2011 | Chen et al. | |
| 8,893,824 | B2 | 11/2014 | Downton | |
| 9,115,540 | B1 | 8/2015 | Williams et al. | |
| 9,523,263 | B2 * | 12/2016 | Downie | E21B 4/02 |
| 10,563,461 | B2 | 2/2020 | Nanayakkara | |
| 10,584,535 | B1 * | 3/2020 | Carpenter | E21B 7/20 |
| 2001/0045300 | A1 | 11/2001 | Fincher et al. | |
| 2018/0252042 | A1 * | 9/2018 | Nanayakkara | E21B 4/02 |
| 2018/0328111 | A1 | 11/2018 | Ross | |
| 2019/0353009 | A1 * | 11/2019 | Nanayakkara | H02K 7/1807 |
| 2020/0340351 | A1 * | 10/2020 | Harvey | E21B 44/04 |

OTHER PUBLICATIONS

International Search Report for PCT/US23/74590 dated Mar. 22, 2024.
NOV Brochure—Enhancing RSS Operations (2020).
Drilling manual—Measurement while drilling guide (2017) (https://www.drillingmanual.com/measurement-while-drilling-mwd-tool-oil-gas/).

* cited by examiner

*Primary Examiner* — Tara Schimpf
*Assistant Examiner* — Ursula Lee Norris
(74) *Attorney, Agent, or Firm* — Boulware & Valoir PLLC

(57) ABSTRACT

The disclosure describes a BHA that generates electricity downhole which can then be utilized with an electric motor to turn the drive shaft and for drive shaft orientation. The disclosure also describes a more accurate MWD measurements by placing MWD sensors closer to drill bit.

20 Claims, 10 Drawing Sheets

BHA WITH ELECTRIC DIRECTIONAL DRILLING MOTOR

PRIOR RELATED APPLICATIONS

This application claims priority to U.S. Ser. No. 63/378,633, BHA WITH ELECTRIC DIRECTIONAL DRILLING MOTOR, filed Oct. 6, 2022, and incorporated by reference herein it its entirety for all purposes.

FEDERALLY SPONSORED RESEARCH STATEMENT

Not applicable.

FIELD OF THE DISCLOSURE

The present disclosure generally relates to downhole drilling tools, more particularly to a bottom hole drilling assembly that will create enough electricity to power an electric drilling motor. The ideal device would allow operators to change the operating parameters of the downhole tools while in the hole and have a greater degree of freedom than the conventionally used hydraulic or mechanical tools.

BACKGROUND OF THE DISCLOSURE

To obtain hydrocarbons from subterranean formations, a wellbore is first drilled at the desired site. The process of drilling an oil and gas well is typically done by a rotating drill bit used to crush or cut rocks. The basic equipment for drilling a well-bore has parts above the ground—called the derrick—that supports the subterranean drilling equipment—called bottomhole assembly (BHA)—with a drill string connecting the two. See e.g., FIG. 1 showing simplified derrick 101, draw-works 103 for lifting the drill string, top drive 105 for rotating the drill string, mud pump 107 providing drilling fluids to the drill pipe 109 and the BHA 111. A control system 113 contains communication and control means and the processors, display and input devices needed to run the system.

The BHA in FIG. 1 is highly simplified with many details omitted, but may include various additional parts including the bit, bit sub, a mud motor, stabilizers, drill collar, drillpipe, jarring devices and crossovers for threadforms. The BHA should be able to provide enough force for the bit to break the rock while drilling, survive hostile mechanical and chemical environments and provide the driller with directional control of the well. For this, more commonly used BHAs include a mud motor, directional drilling and measurement equipment, measurements-while-drilling (MWD) tools, logging-while-drilling (LWD) tools and other such specialized devices.

The mud-motor consists mainly of the mud motor housing, inside of which is the steel stator and generally spiral rotator shaft inside the stator. Mud fluid is pumped into the motor and the force of the fluid causes the rotator shaft to rotate within the stator. Thus, it is a positive-displacement motor (commonly called a "PDM"). The rotational force is then transmitted through the connecting rod and drive shaft to the bit.

Directional drilling was originally achieved with a BHA that had an adjustable bend. A standard downhole mud-motor tool in the industry is an adjustable bent housing mud motor (described in U.S. Pat. No. 9,115,540). These motors have a power section with a power cavity end, wherein the drive shaft that goes to the bit through a bent housing forces the bit to point slightly off axis of the drill string above the motor. With such a drill it is possible to make a gentle curve to switch from vertical drilling to horizontal.

FIG. 2 shows such a device with a top sub 201 for connecting to other components, a non-rotating tubular housing 203 having a region that can be adjustably bent 205 on the surface, a power section 207 (the mud motor), a drive shaft assembly translating the fluid flowing through the power section to the bit box 209 and bit 211. Bearing assembly 213 allows the internal parts to rotate without rotating the tubular external housing.

Directional control with a bent housing motor assembly is achieved by orienting the bend in the desired direction and drilling with no rotation of the drill string and BHA (commonly referred to as "slide drilling"). Traditionally, once the directional adjustment has been made and slide drilling completed, drill string rotation is resumed to drill in rotary drilling mode without removing the bend. Thus, during rotary drilling, the motor bend rotates with the drill string, preventing the use of the bend to provide directional control.

To reduce inventory, adjustable bent housing units have a mechanism that allows the operator to change the degree of bend with a simple Allen wrench. However, this must be done at the surface. Therefore, the BHA and drill bit must be pulled out of the hole and manually adjusted before putting it back in the wellbore. This is a significant disadvantage as it is both expensive and time consuming. In addition, the rotational speed is directly proportional to the flow rate of drilling mud or other fluid into the mud motor, which often causes problems in controlling the rotary speed.

Newer technology uses hydraulics and pressure changes to control the degree of bend. Angles are preset in the workshop, then adjusted in use by changing the mud flow rate. Angles downhole are determined by a measurable pressure drop. The drawback here is that the detection of the pressure drop signal may not be accurate.

One important development in directional drilling was the Rotary Steerable System (RSS). These drill directionally with continuous rotation from the surface, eliminating the need to slide a steerable motor. They are typically used when drilling directional, horizontal, or extended-reach wells.

The RSS operates by exerting a consistent side force similar to traditional stabilizers that rotate with drill string, or orienting the bit in the desired direction while continuously rotating at the same number of rotations per minute as the drilling. There are two basic technologies, albeit with many variants—1) pads that push on the side of the borehole, thus moving the bit in the opposite direction; or 2) internal bending of the shaft via eccentric rings to point the bit in the correct direction (see FIG. 3A-B).

U.S. Pat. No. 10,563,461 describes a hybrid drilling system whereby the steering head of the drilling system is maintained stationary while the outer housing for the drilling assembly rotates. The hybrid drive utilizes a turbine and electric motor/generator to provide the rotary power for the drilling assembly. The rotational speed of the turbine in this case is directly proportional to the flow rate of drilling fluid into the turbine. This still may cause problems in controlling the rotary speed.

What is needed in the art is a method of drilling that avoids some of these disadvantages. The ideal method or device would allow operators to change the operating parameters of the downhole tools while in the hole and have larger degrees of freedom than the conventional hydraulic or mechanical tools. A preferred method or device will also provide the advantage of having the MWD closer to the drill bit and/or the ability to use the electric power to communicate effectively with the control system above ground.

SUMMARY OF THE DISCLOSURE

Current drilling systems use a mud motor to drive the bent housing motor which is set at either a fixed or (very new) hydraulically adjustable angle. The mud motor takes up the entire cross-section of the drill pipe for the length of the mud motor, and must be physically connected to the drive shaft for operation. This limits the sensors and electronics available at or near the drill bit, forcing their placement above the mud motor, quite distant from the bit. Some tools can run a low voltage wire across the mud motor/drive shaft, but there is limited space, and there is very low voltage (~500 mA) for data collection.

Other BHA/MWD tools have a small propeller driven power source that when coupled with a good battery allow some MWD's to operate various gauges and tools. However, these are still very low power in the mA range, and thus lack sufficient power to drive the drill bit.

In the disclosure herein, we use the mud motor to generate the electrical power needed to drive an electric motor to drive the drill bit—thus decoupling the mud flow from drill bit speed. By capturing hydraulic power from the mud motor, the current invention can generate horsepower scale energy, much greater than the milliamps previously used for low voltage signaling. The mud motor can generate hundreds of horsepower (100-1000 horsepower or 75-750 kilowatts) or more to run larger electric motors, solenoids, and the like. The generation of significant power in close proximity to the drill bit is new and opens significant opportunity to dramatically improve BHA design and function.

The electric motor itself may be either an AC or DC motor. DC motors are lighter and a brushless DC may be the most efficient, but an AC induction motor may have more torque, where needed in harder rock. Further, because there is additional power available in the BHA, the BHA can have many more functions and capabilities, although the primary function is still to rotate the drill bit with the electric drive motor.

One of the secondary developments described herein is the ability to change bit angle downhole. Since the mud generator provides significant electrical power, it can also drive a steering mechanism or side force package. The mud motor and generator are on one side of the "bend angle" while the MWD, electric motor, and drill bit are on the other side of the bend angle. By changing the angle of the side force package, the motor bend setting may be changed without pulling up the string and BHA to allow for improved directional control. The angle can be changed with either an electric solenoid or a hydraulic system run electrically using sliding pistons or pads or eccentric rings to provide increasing bend angles. In one embodiment, a hydraulic piston with an electric pump is attached on both sides of a bend angle, as the piston extends the bend angle is increased. In another embodiment, an electric solenoid is attached on both sides of the bend angle, when the solenoid is actuated, it progresses to different bend angles.

A flow channel must be maintained through the electric motor and bit to lubricate the drill bit and wash debris away. That channel is preferably inside a hollow drive shaft for simplicity, or it may be adjacent the drive shaft if a solid drive shaft is used.

Direct control of the electric motor has the potential to be far more accurate and prevent damage to the drill bit, electric motor, and mud motor. The electric drive can stop instantly either from surface or due to downhole conditions. Because the electric motor speed is independent of mud flow, the electric drive can decrease speed during regular drilling when drill string is rotating. It can also increase speed during slide drilling when drill string is not rotating. With sensors in place, it can respond quickly to actual downhole conditions, whereas the current mud motor driven system requires a change in mud flow rate to change the speed.

With electric drive and electric control, signals can be sent to and from the BHA/controller in a method called "downlinking." When a signal is sent, the steering mechanism or side force package changes angle and sends a return signal to the surface announcing the resulting angle. With electric motor, sensors and controls, steering accuracy is increased. Electronic pistons can report the angle at given time intervals to ensure the appropriate angle is maintained.

Any mechanism for changing the angle may be used, including point the bit and push the bit types, but preferably, sensor and electronic controls allow angle changing to be performed downhole. This is now possible because the mud motor and its power generation are above the MWD and the side force package, providing significant power to control the side force package that was not available in the prior BHA designs. Placement of the side force package below the mud motor is also important, providing steering closer to the MWD and the drill bit.

Any mechanism for reporting the angle may be used. For example, one can measure eccentricity while drilling using two sets of caliper sensors coupled with a fiber-optic gyroscope for continuous attitude measurement. Electromagnetic sensors can also track the progress of the drill bit.

Commonly, the MWD package provides a variety of measurements, including sensors for directional drilling, that can provide inclination, azimuth and toolface. MWD also can provide a pressure transducer for measurement of pressure, temperature sensors, downhole weight on bit and torque on bit, downhole shock and vibration, formation evaluation, natural gamma ray sensors, formation resistivity, short normal resistivity (SNR), focused current resistivity (FCR), toroidal resistivity, electromagnetic wave propagation resistivity MWD sensor, neutron porosity MWD sensor, formation density MWD sensors, and the like.

In one embodiment of the invention, the new BHA would include a drill bit with an electric drilling motor containing a drive shaft with side force package to create a bend in the drive shaft. A mud motor is used to provide hydraulic energy that is converted to electricity to power the electric motor. The electric motor provides torque to the drive shaft with a bearing pack carrying axial load that is located below, inside or above the electric motor, shock absorber attached to the bearing pack and a variety of sensors to measure the functionality, such as the behavior of the BHA, directional drilling parameters as well as rock properties. The BHA can also have a conventional MWD, with a power conduit and optional battery to transfer power as needed.

The electric motor allows the electronics to be moved below the mud motor power section. In the prior art with a bent housing mud motor, the electronics were placed above the mud motor due to the difficulty of bringing electronics through the mud motor. In the prior art (U.S. Pat. No. 9,115,540) the MWD was up to 60 ft away from the bit. In the presently described electric drilling, the power above the MWD allows the MWD to be electronically connected with the BHA from the battery, to the MWD, all the way to the electric motor and drill bit. Thus, various control and sensor tools can be placed within 5 or 6 ft of the drill bit, possibly even less, thus allowing much greater control and accuracy.

To improve MWD measurements, magnetic signals generated by the electric power generator, the electric drive motor, and electric power cables can be mitigated by shielding the power cable, cancelling the magnetic noise, or powering down during connections and drilling stops when all electronics can be powered down. The MWD may be isolated by non-magnetic drill collars, the "non-mag" size can be determined by the magnetic interference generated by the generator and motor. Finally, gyroscopic measurements can be used to either replace magnetic measurements or be taken in conjunction with other MWD measurements. MWD can also include gamma ray measurements directly behind the bit allowing the drilling to better "hit the pay."

The new tool preferably also communicates with the surface using standard communication in the industry—mud pulse, EM tool through rock, mud transmission through nano-fibers/graphite, sound vibrations through pipe, electric signals (e.g., by cables 425 in FIG. 4A and 525 in FIG. 5A), and the like can be used to communicate with the MWD, controls, electric drive, or other equipment in the BHA.

Because the electric motor is running the drill, the hydraulic mud motor will have less stress. Additionally, flow through the mud motor can be set at a consistent and safe speed, while electric motor provides all torque independently of mud flow. Drill bit rotation is completely adjusted by the electric motor—when the drill string is rotating, the electric motor slows to keep constant bit speed. When slide drilling (no drill string rotation) the electric motor can rotate much faster to keep drill bit at speed. Separating drill bit speed from mud flow also allows the driller to change the bit speed and keep good mud flow across the drill bit face. Better mud flow pushes debris and cools the drill bit better. The electric motor can be programmed to respond to high torque/resistance situations automatically. This is far superior to existing technologies.

Measurement of stick slip, which compares top drive rotations to actual rotations downhole, found that the rotation rate at the top drive ended up having dramatic fluctuations downhole when using a prior art BHA. For example, if the top drive was rotating at 100 rpm, the drill string at the bit may fluctuate by up to 60 rpm (40 rpm-160 rpm) because of stick-slip and the dynamics of a very long steel drill string. Not only do the rotations fluctuate, the rapid release of stick-slip can cause damage to the drill bit, drill string, and motor. With the electric drive system described herein, however, the electric motor, sensors and controls identify and adjust rotation regardless of drill string rotation. Stick slip of the drill string can automatically be accounted for and compensated at the bit, thus reducing or eliminating stick slip slowing and rapid release.

The invention includes any one or more of the following embodiments, in any combination(s) thereof:

---

An electrically driven bottom hole assembly (BHA) comprising:
a) a mud motor operatively coupled to an electric power generator, said electric power generator utilizing said mud motor to convert hydraulic power from said mud motor to electrical power;
b) a power management system below said mud motor, said power management system electrically coupled to said electric power generator and comprising:
i) a measure-while-drilling (MWD) electronic sensor(s) operatively coupled to said BHA to measure drilling parameters and rock properties;
ii) a drive shaft and a side force package for directional control of said drive shaft; and
iii) an electric drilling motor for driving a drill bit at a bottom end of said drive shaft; and
iv) one or more optional sensors for measuring temperature, drilling speed, drilling direction, torque, and the like; and
c) said electric drilling motor operatively connected to said drive shaft for rotating said drill bit.

A bottom hole assembly (BHA) for directional drilling, comprising:
a) a rotatory drill bit operatively connected to a sensor and a drive shaft operatively connected with a drive shaft orienting mechanism, a bearing pack, and a shock absorber;
b) an electric motor operatively coupled to said drive shaft;
c) measuring-while-drilling (MWD) sensors placed within 6 ft of said drill bit with sensors and means for communication; and
d) a mud motor above said MWD sensors and said electric motor, said mud motor operatively coupled to an electric power generator to convert hydraulic power to electricity for rotating said drill bit.

An electrically driven bottom hole assembly (BHA) comprising:
a) a drill bit at a bottom end of said BHA;
b) an at-bit bend sensor operatively coupled to said drill bit;
c) an electric drilling motor connected to a drive shaft and a drill bit orienting mechanism to create a bend in said drive shaft, said drive shaft attached to said drill bit;
d) said drive shaft connected to a drive shaft shock absorption sub unit;
e) a bearing pack to carry axial load located below, or inside or above said electric drilling motor;
f) measure-while-drilling (MWD) sensor(s) to measure drilling parameters and rock properties; and
g) an electric power generator coupled to a mud motor for converting hydraulic energy to electric energy, said electric power generator capable of storing power in a power transfer tool, said power transfer tool electrically connected to said electric drilling motor.

Any BHA herein described, wherein said MWD is placed between said mud motor and said drill bit.

Any BHA herein described, wherein said power management system comprises a processor, an electric transformer, a battery, or a combination thereof.

Any BHA herein described, wherein MWD sensors are placed within 6 ft of said drill bit, or within 5 ft, or even within 4 ft or less.

Any BHA herein described, further comprising a battery electrically coupled with said electric power generator, said electrical drilling motor and said MWD sensor(s), plus any other added sensors or surface communication devices.

Any BHA herein described, further comprising a controller electrically coupled to said electrical drilling motor and said MWD sensor(s). The controller can be electrically connected to a surface processor or computer for directing down hole activities.

-continued

Any BHA herein described, wherein said drive shaft is hollow to convey mud from said mud motor to said drill bit.
Any BHA herein described, wherein said drill bit and said mud motor can operate simultaneously, or can operate independently.
Any BHA herein described, said side force package comprises a piston, and wherein said piston is actuated to adjust a bend angle of said drive shaft.
Any BHA herein described, wherein said MWD sensor(s) and any other sensors are placed betweens aid mud motor and said drill bit.
Any BHA herein described, wherein said power transfer tool is an electric transformer or a battery.
Any BHA herein described, wherein said bearing pack is placed between said bit and said at-bit sensor.
Any BHA herein described, wherein said drill bit rotates by using electrical power generated by said electric power generator, and said mud motor operates simultaneously using hydraulic power from flowing mud.

As used herein, the terms "above" or "below" are for convenience and refer to the assembly when in a vertical orientation. However, drilling need not be always vertical and is often horizontal. Thus, being above means it is closer to the derrick, even if not literally above in 3D space.

The use of the word "a" or "an" in the claims or the specification means one or more than one, unless the context dictates otherwise.

The term "about" means the stated value plus or minus the margin of error of measurement or plus or minus 10% if no method of measurement is indicated.

The use of the term "or" in the claims is used to mean "and/or" unless explicitly indicated to refer to alternatives only or if the alternatives are mutually exclusive.

The terms "comprise", "have", "include" and "contain" (and their variants) are open-ended linking verbs and allow the addition of other elements when used in a claim. The phrase "consisting of" is closed, and excludes all additional elements. The phrase "consisting essentially of" excludes additional material elements, but allows the inclusions of non-material elements that do not substantially change the nature of the invention, such as instructions for use, buffers, and the like. Any claim or claim element introduced with the open transition term "comprising," may also be narrowed to use the phrases "consisting essentially of" or "consisting of," and vice versa. However, the entirety of claim language is not repeated verbatim in the interest of brevity herein.

As used herein, a "side force package" is any device or combinations of devices that can change the bend angle of a BHA drill bit and include push the bit, point the bit, eccentric rings, pistons, and any other known or to be developed system.

The following abbreviations are used herein:

| ABBREVIATION | TERM |
|---|---|
| AC | Alternating current |
| BHA | Bottomhole Assembly, typically the drill bit is not considered part of the BHA in the art, but we have included it in certain claims for ease of claiming. |
| DC | Direct current |
| EM | Electromagnetic |
| FCR | Focused current resistivity |
| LWD | Logging while drilling |
| MWD | Measurement while drilling |
| PDM | Positive displacement motor |
| RSS | Rotary steerable system |
| SNR | Short normal resistivity |

DETAILED DESCRIPTION

Figure 1:
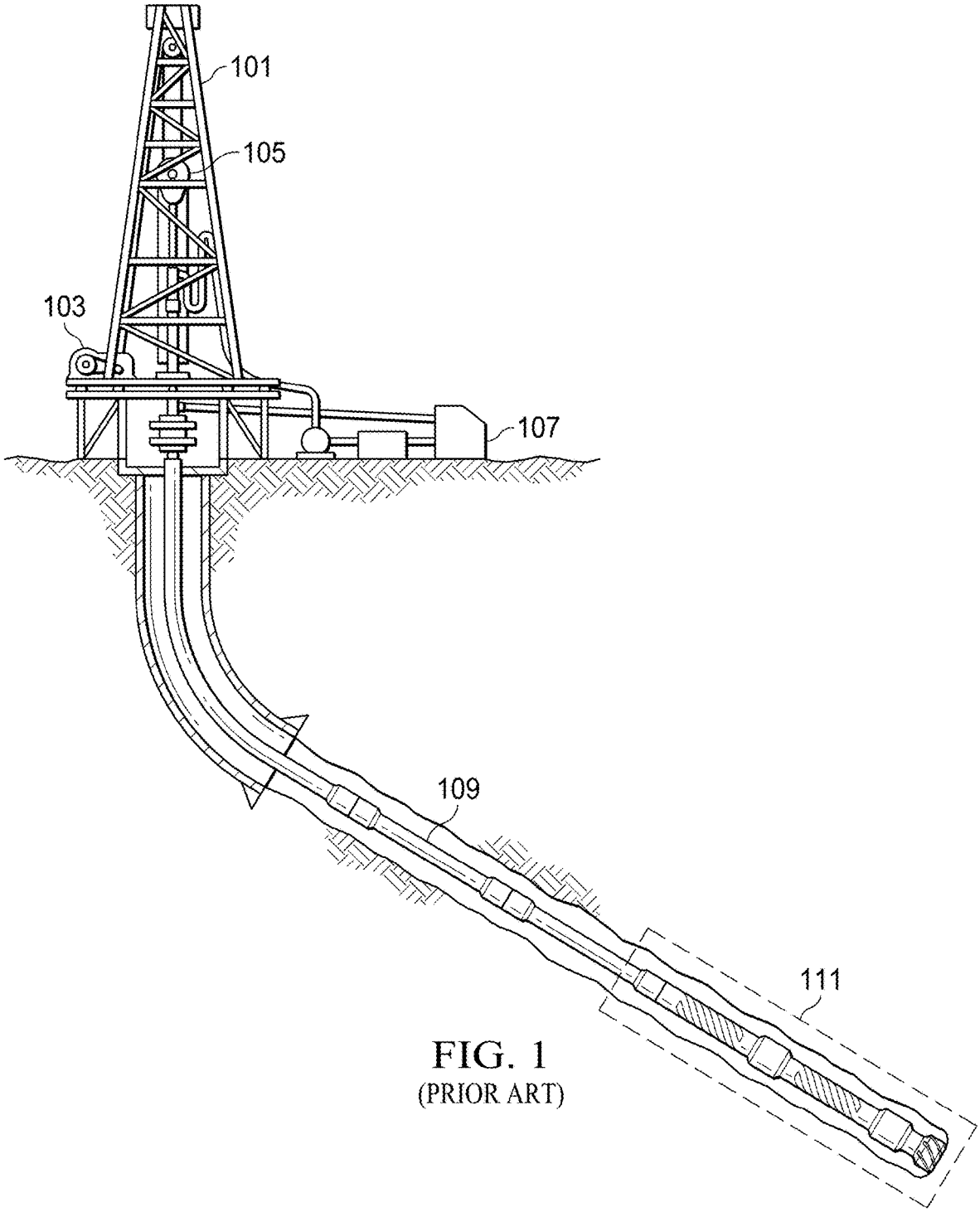
FIG. 1 (PRIOR ART)
FIG. 1 (prior art) shows a simplified schematic of a drilling derrick, drill string and BHA downhole.
Figure 2:
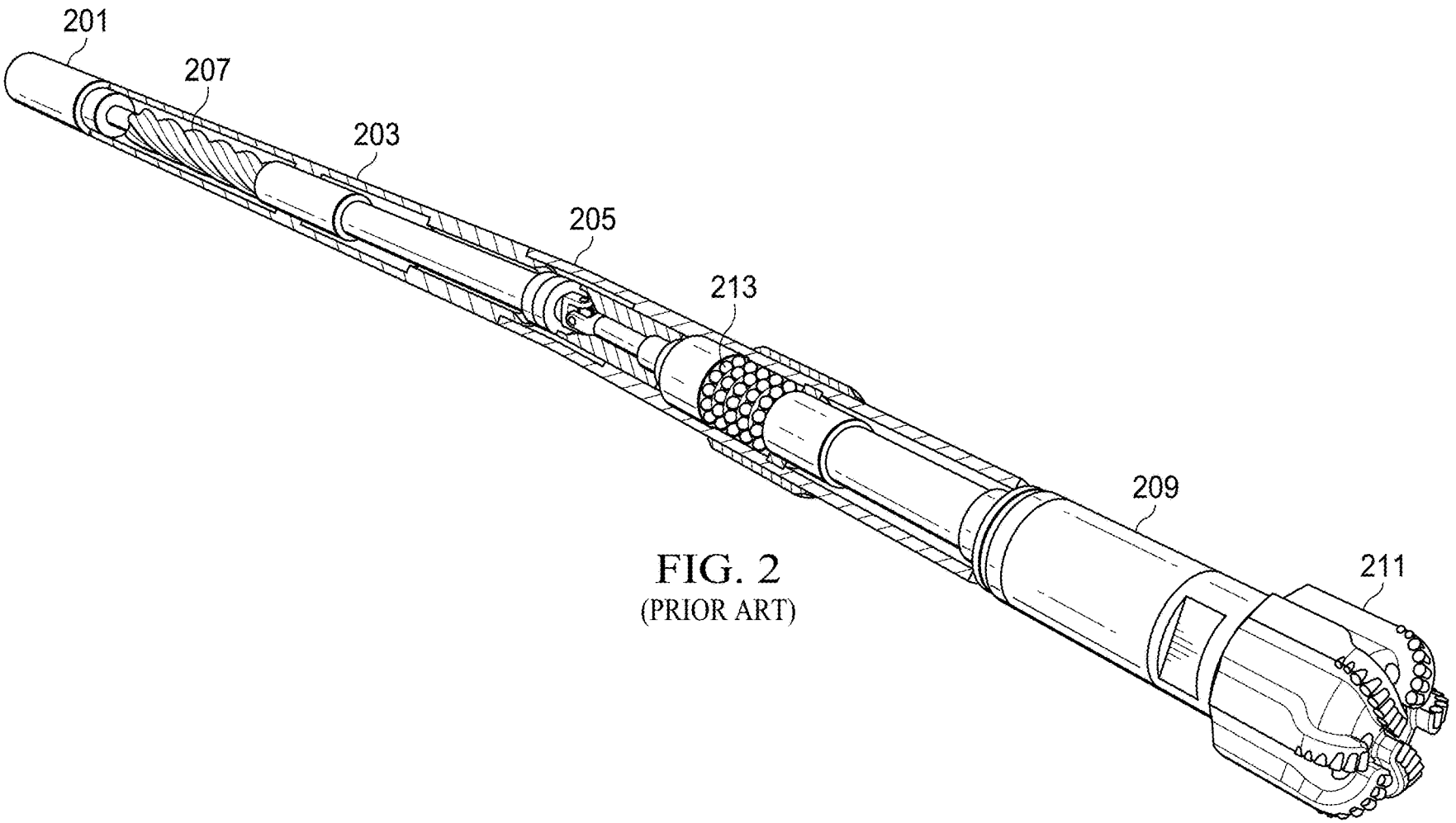
FIG. 2 (PRIOR ART)
FIG. 2 (prior art) is a representation of a mud motor, bent housing BHA.
Figure 3A:
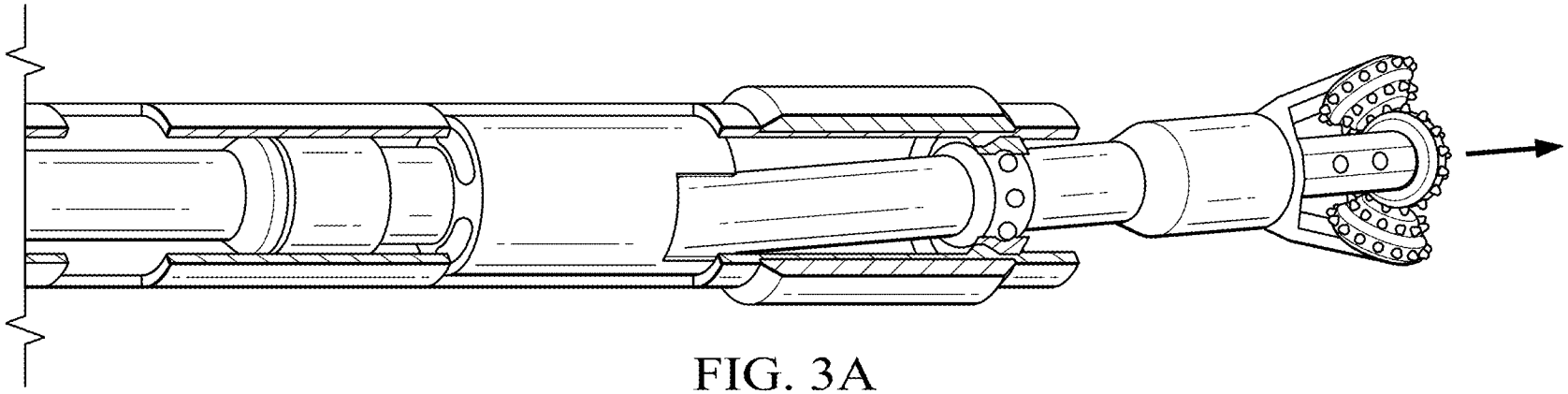
FIG. 3A (PRIOR ART)
FIGS. 3A and 3B (prior art) shows two types of RSS known in the art—a point the bit RSS (3A) and a push the bit RSS (3B).
Figure 3B:
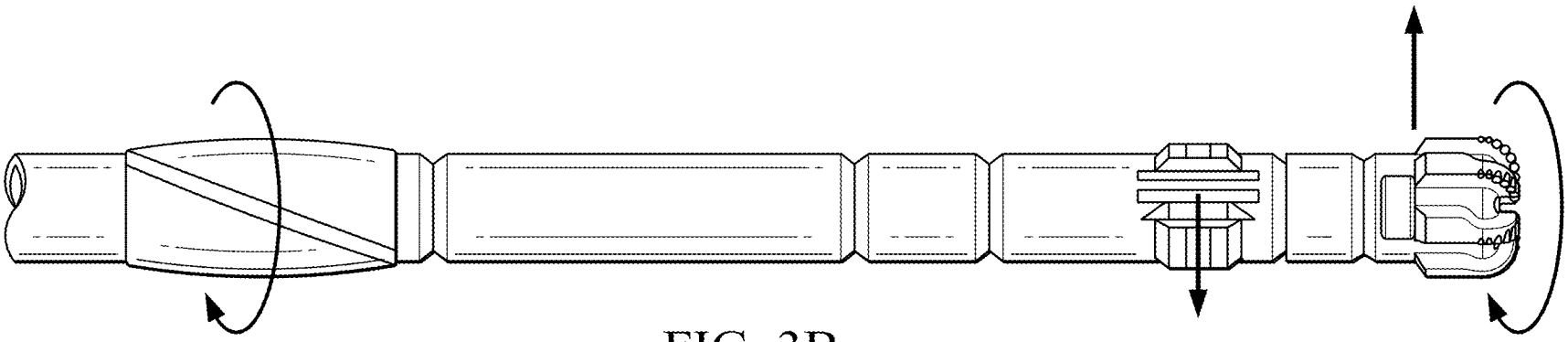
FIG. 3B (PRIOR ART)

There are several ways to assemble a BHA with the drill bit, mud motor, placing MWDs, and communicating parameters to control unit on the surface. Herein we use mud motor and an electric power generator to convert the hydraulic energy from the surface mud pumps to generate electricity downhole to run an electric motor that drives the drill bit. This allows the MWDs to be placed below the mud motor power section of the BHA and much closer to the bit assembly, and also allows other tools to be electrically driven and controlled, such as the side force package.

To illustrate the advantages of the electric motor driven BHA, a well is drilled using the electric motor-containing BHA described herein and a second well drilled using the conventional hydraulic motor. The drilling operation is continued for a total of 1,000 feet when a change of drill bit speed is desired. We expect that the electric motor of this disclosure can be adjusted in real time when the drilling conditions require change. For example, when the drill bits encounter an unexpected rock formation, increasing rotary speed is necessary to maintain the drilling rate. With conventional motors, the drill bit speed can only be adjusted by changing the mud pump rate or the drill string rotational speed, both of which have additional impacts on the drilling process that may not be advantageous. With an electric motor, the drill bit speed can be changed as desired, independently of mud flow.

Contrary to the conventional configuration where the bend angle is preset prior to drilling, the bend angle of the drill bit according to this disclosure can be adjusted in real time depending on the drill plan and the actual drilling angle. Low motor bend settings are typically used to nudge the well back on plan in sections where the directional plan is relatively straight. In sections where significant directional changes, such as the curve section where the well is turned from drilling close to vertical to drilling horizontally, a motor with a higher bend setting would be used in the prior art. The higher bend mud motors are not designed to drill in rotary mode for extended periods as this is likely to cause mechanical failure. As a result of the need for different bend settings in different well sections, it is common practice to pull the entire drill string out of the well for the single purpose of changing the mud motor with one having the applicable bend setting. The new electrically driven BHA would eliminate the need to change out the directional motor, as the bend setting could be simply changed by sending a signal from surface.

For energy-intensive downhole drilling operations different configurations of the power generator are proposed. One approach is to provide battery packs as a power source for the drill bits. Lithium-thionyl chloride batteries are used in MWD systems because of their excellent combination of high-energy density and superior performance at MWD service temperatures, and provide a stable voltage source until very near the end of their service life. These batteries have limited instantaneous energy output, and they may be unsuitable for applications that require a high current drain. However, considering the amount of energy required for downhole drilling, changing battery packs would also interrupt the drilling operation. Thus, batteries alone are not very practical.

Another approach is to use a downhole power generator, such as a turbine generator or a mud motor, to power the drill bits. A turbine generator generally takes advantage of the kinetic or hydraulic energy provided by the downhole fluid. In one example, the downhole power generator can comprise an inlet in a downhole tool string component for conveying a flowing downhole fluid (or mud) and a turbine coupled to the inlet to receive the downhole fluid. The turbine is then used to convert the kinetic energy of the flowing downhole fluid into rotational energy, which is stored in a battery and/or used to drive the electric motor which powers the drill bit.

Other downhole electrical power generator designs also utilizes the flowing downhole fluid, but employs different mechanisms for power generation. For example, magnetic shafts may be used inside a tubular, conductive housing. Once the magnetic shafts are driven by flowing downhole fluid and move inside the conductive housing, electrical current is generated, which can then be used to power the motor that drives the drill bits.

We expect that the optimal design will capture the hydraulic energy of mud flow and convert it to electric energy, plus a battery will be used to store excess energy and to assist with any power fluctuations. Preferably, that battery is rechargeable downhole, obviating the need for frequent battery changes.

Figure 4A:
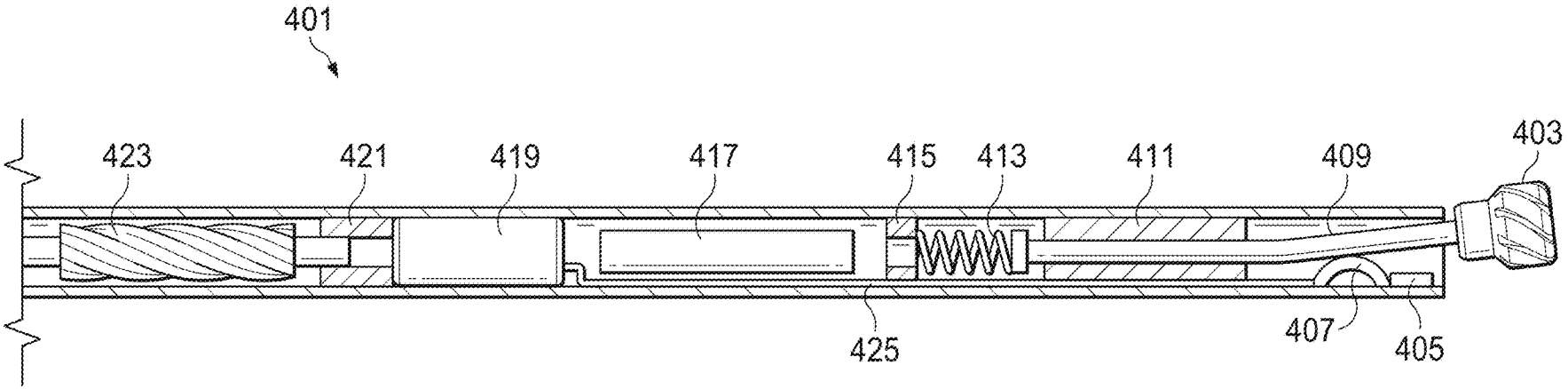
FIG. 4A shows a simple schematic view of the invention as disclosed.

FIG. 4A presents the assembly of one embodiment of the BHA (401). The bit (403) of the drill is connected to an electric drive motor (411) via a power cable (425). The motor (411) is connected to a drive shaft (409) together with a side force package (407) that creates a bend in the drive shaft. The electric drive motor (411) provides torque to the drive shaft (409). Drive shaft shock absorber (413) is attached to the drive shaft on one side and a bearing pack (415) on the other, which carries axial load. The bearing pack (415) could be located below, inside, or above the electric motor. Power generator (421) provides electricity for the electric drive motor (411) and MWD. A mud motor power section (423) provides the hydraulic power for generating the electricity via the power generator (421). A power control package (419) containing a battery manages excess power generation and the transmission of power to the power conduit (425) placed near the MWD (417).

The side force package (407) is used to adjust the bend angle of the drill bit at either predetermined intervals or can be used to adjust the bend angle continuously. For example, the side force package (407) can have gears or eccentric rings actuated by the drive shaft (409) and gradually change the bend angle of the drill bit (403) away from the drive shaft (409). Alternatively, a piston may be mounted at a joint to increase bend angle. When the piston is extended, it increases the length on one side of the joint forcing the bit away from the bend. The piston may have graduations that correspond to various drill angles and the piston can be extended different lengths to achieve different bend angles. However, any side force mechanism described herein or available in the art can be used.

In one embodiment, the bend angle sensor (405) or MWD (417) detects either the bend angle or position of the drill bit (403) while drilling, and conveys the information back to the controller at the surface (not shown here, but see (113) in FIG. 1). Depending on how the drilling progresses, the control unit can adjust the bend angle as needed. With electric drive and electric control, communication signals can be sent to the BHA/Controller by downlinking from surface. When signal is sent, the motor changes angle and sends a return signal announcing the new angle. With electric motor and piston, both accuracy and confidence are greatly increased.

"Downlinking" in drilling refers to the process of communicating from the surface to a downhole tool. The downhole tool can be any number of devices, but downlinking is typically in reference to communication with measurement while drilling (MWD), logging while drilling (LWD) or rotary steerable systems (RSS). The downlinking process can communicate instructions and sensor data between the surface and down hole, and change operating parameters based on a range of variables including pressure fluctuations (via downhole pressure gauge), flow (through downhole turbine), vibration (via downhole accelerometers), rotation (through downhole magnetometers) and EM telemetry (through the earth to downhole receiving antenna), electrical signals, and the like.

Figure 4B:
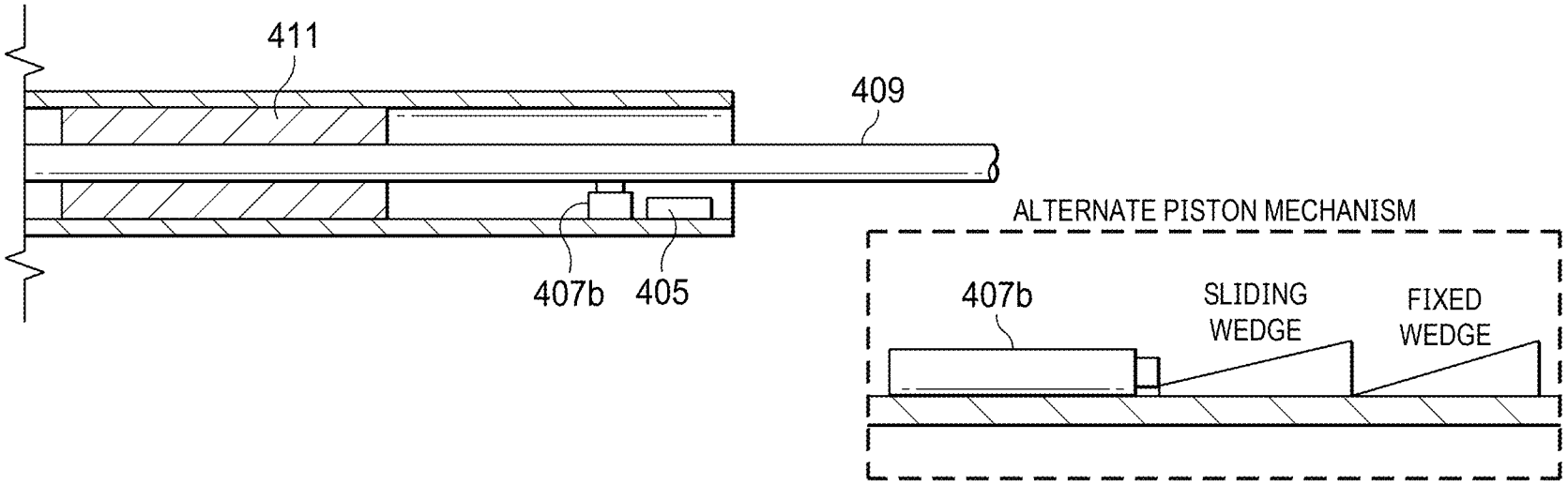
FIGS. 4B, 4C and 4D show close ups of alternate piston arrangements in simple schematic.
Figure 4C:
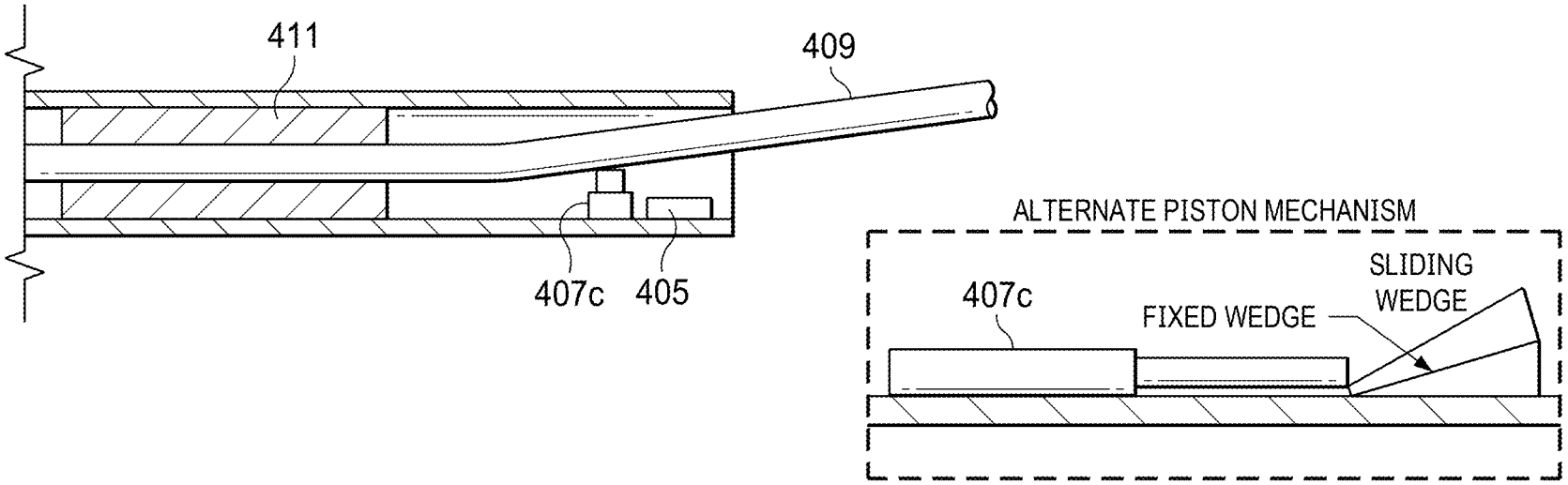

In one embodiment, as shown in FIG. 4B a piston (407*b*) is employed to push drive shaft (409), the remaining numbers unchanged. In FIG. 4C, an inline piston (407*c*) is used to drive a sliding wedge 432*b* that can move on top of a fixing wedge (432*a*). As shown when the piston (407*c*) is retracted, the sliding wedge (432*b*) stays away from the fixed wedge (432*a*). This way, the bit maintains a smaller (or zero) bend angle. When more significant bend angle is required the piston (407*c*) is extended, and it pushes the sliding wedge (432*b*) on top of the fixed wedge (432*a*) and forces the bit (403) a greater bend angle. The actuation of the piston (407*b* or 407*c*) can be controlled on the wellpad or can be pre-programmed and executed by the MWD (417).

Figure 4D:
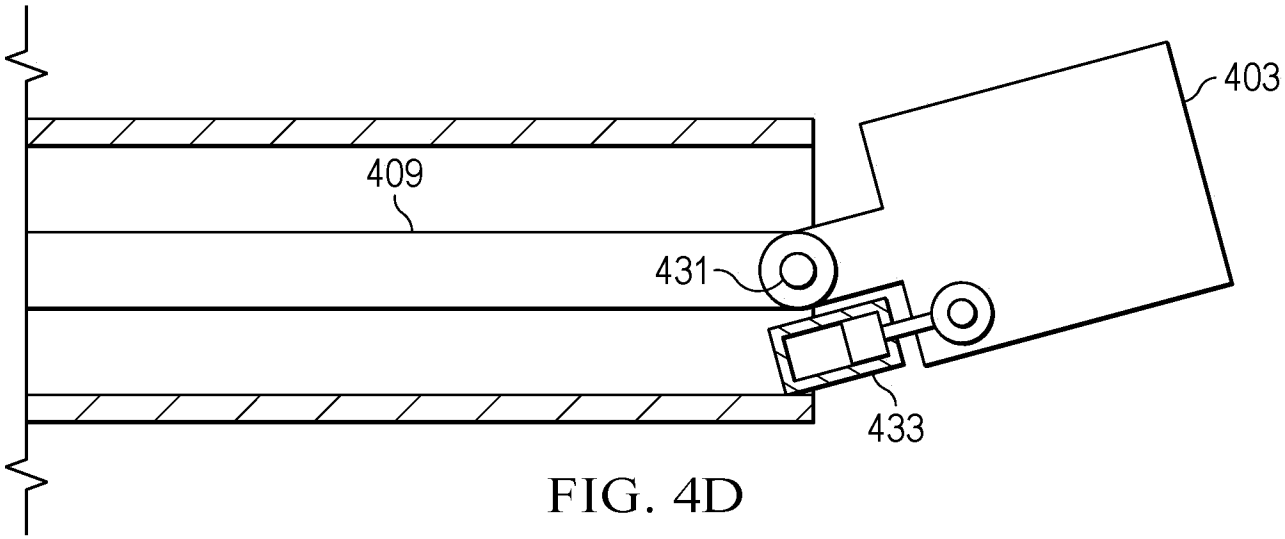

Alternatively, as shown in FIG. 4D, a piston (433) may be mounted at a joint (431) to increase the bend angle. When the piston (433) is extended, the length on one side of the joint (431) is increased, thereby forcing the bit (403) away from the bend. The piston may have graduations that correspond to various drill angles and the piston can be extended different lengths to achieve different bend angles.

It is to be noted that the side force package (407) can be replaced by other mechanisms that change the bend angle known to those skilled in the art. For example, a different mechanism involving layers of rotational sleeves may be used to gradually change the bend angle. Other bend angle-adjusting mechanisms available to be electronically actuated can be incorporated instead.

Figure 5A:
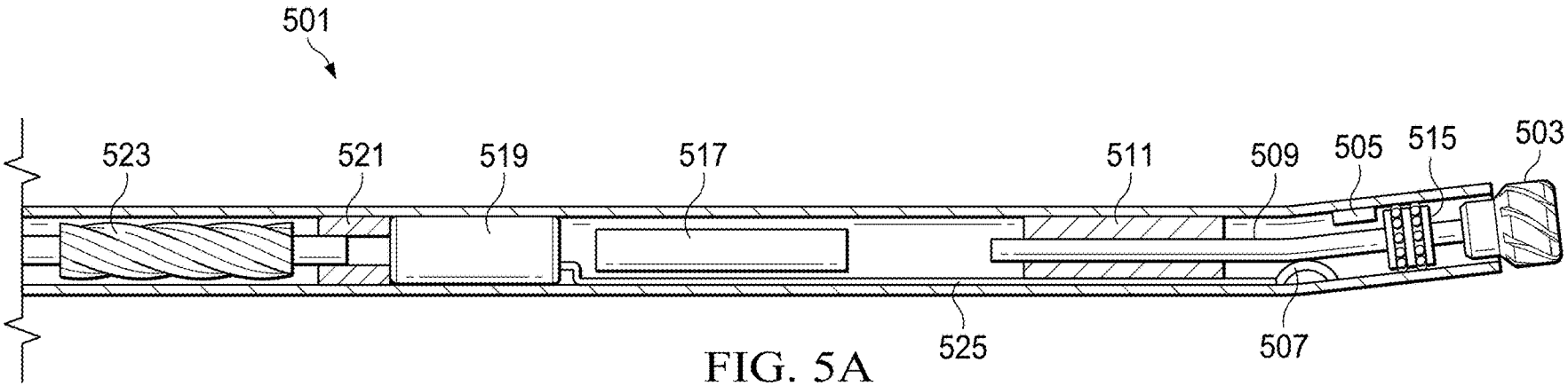
FIG. 5A is a simple schematic view of another embodiment of the invention.

FIG. 5A show another way of assembling the drill bit without the shock absorber unit. The drill assembly (501) shows the bit (503) attached to the drive shaft (509) and separated from the at-bit sensor (505) by a bearing pack (515). This places the bend angle sensor (505) closer to the MWD (517) thereby providing more accurate readings from downhole. While not visible herein, the drive shaft may be hollow, thus allowing mud flow to continue to the bit.

Figure 5B:
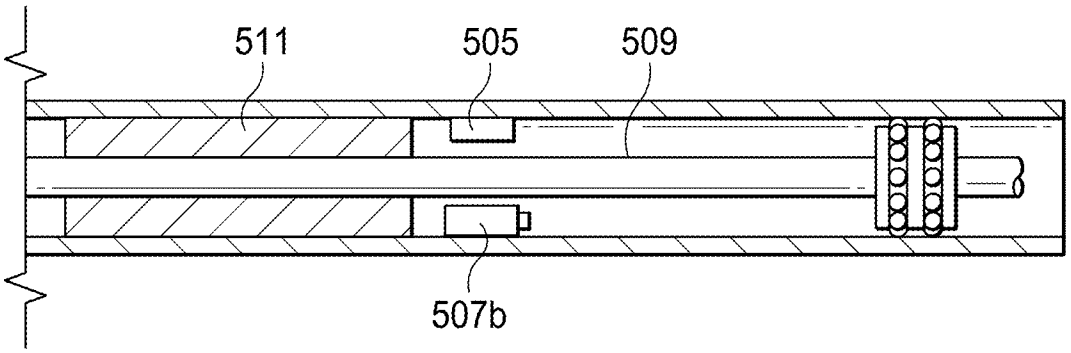
FIGS. 5B and 5C show close ups of alternate piston arrangements in simple schematic of the embodiment shown in FIG. 5A.
Figure 5C:
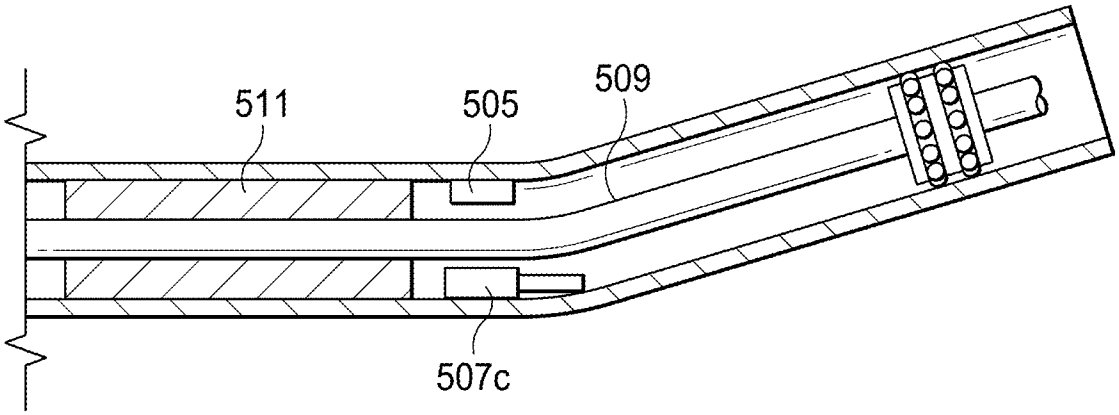

A bent housing adjustment tool (507) is placed to create accurate bend (507*b* and 507*c*) of the bent housing, thus adjusting the orientation of the drive shaft (509). In FIG. 5B, the eccentric ring or gear is positioned so as to not create bend, but when rotated to provide a greater diameter, it will cause a bend as in FIG. 5C.

The assembly is powered by an electric drive motor (511) that is connected to the electric power generator (523) to generate electricity from the hydraulic power of the mud motor (521) via power cable (525). A transformer/battery (519) is also connected to the electric power generator (521) to store power and use as required to run the electric motor, MWD, sensor and controls.

Figure 6A:
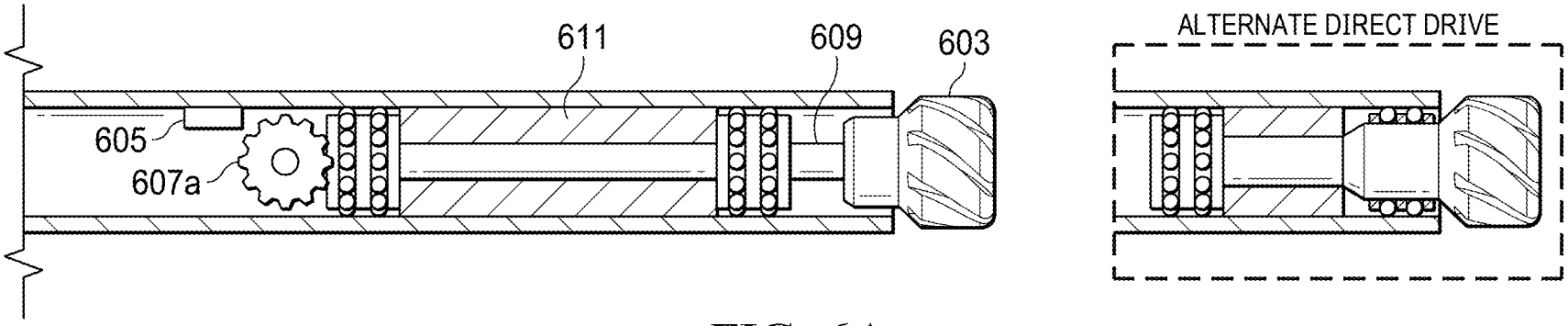
FIGS. 6A and 6B is a simple schematic view of another embodiment of the invention.
Figure 6B:
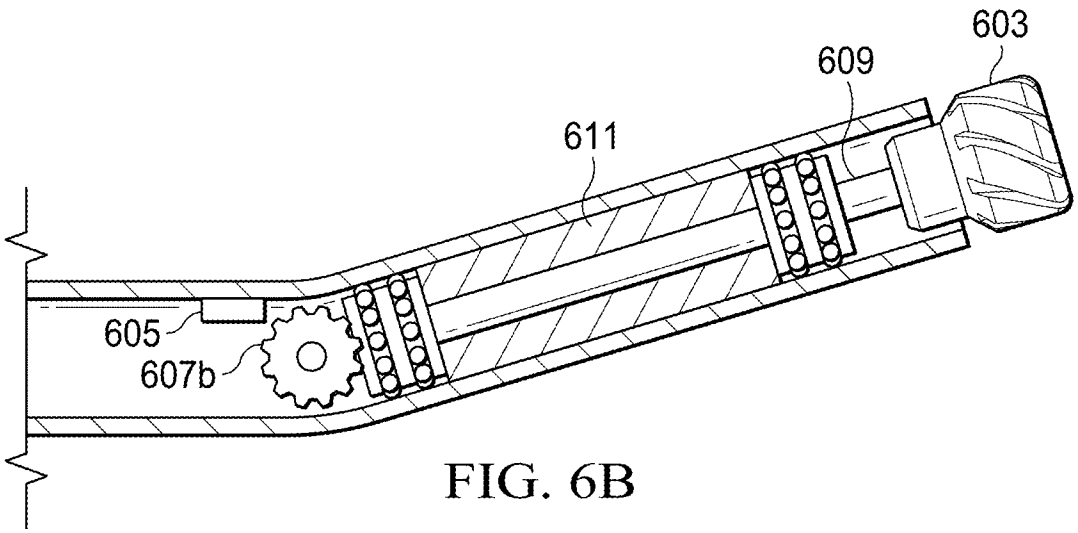

In yet another embodiment, FIG. 6A demonstrates that the bend angle (607*a*) may be behind the electric motor (611) and, when rotated (607*b*) in FIG. 6B, direct the entire drive mechanism including the motor, drive shaft (609) and drill bit (603). This allows the motor and drill bit to be more directly connected eliminating complex drive shaft mechanisms and failure points. In this case the bend may be driven by a mechanism similar to FIG. 5, or as in FIG. 6, may be driven by angling the motor and drill bit.

Prophetic Example 1

To test the feasibility of an electrical downhole motor, provisional drillings using both the design shown in FIG. 4/5 and a conventional hydraulic drill assembly are carried out for a 1000 feet depth on an existing wellbore. The goal is to test if the electric drive motor and the overall configuration is able to withstand the high temperature and pressure in typical downhole conditions. The results are expected to show that after 1,000 feet of drilling, the electric drive motor retains its functionality by providing sufficient power to the drill bits. Furthermore, the results are expected to show that the maintenance required for the drill assembly of this disclosure is the same, or even less, than the conventional hydraulic drill assembly. The ability to control drill speed and mudflow independently should reduce wear and tear on the entire BHA.

Prophetic Example 2

To test the ability to adjust the bend angle in response to the measured downhole conditions, drilling of a deviation of 45 degree for 1,000 feet is carried out for both the conventional hydraulic drill assembly and the electric drill assembly of this disclosure. As discussed above, the conventional hydraulic drill assembly requires the bend angle to be configured at the wellhead before lowering into the wellbore and thus requires significant time to pull and replace the drill string. The electric drill assembly of this disclosure, on the contrary, has an adjustable bend angle by sending an electrical signal to the drive shaft. The piston in the drive shaft orienting mechanism can be actuated to change the bend angle in real time, saving significant time and money.

Prophetic Example 3

To test the power consumption profile, in response to the measured downhole conditions, drilling of a deviation of 45 degree for 1,000 feet is carried out for the battery pack-only powered electric motor BHA and the mud motor-powered, battery and electric motor type BHA. The downhole conditions are selected to represent an average of 190° F. and 3000 psi environment. The purpose is to test the durability of each configuration for a prolonged period of time.

The results are expected show that the battery pack-only powered BHA under the high pressure-high temperature environment has a reduced runtime, and will require more frequent retrieval to replace the battery pack. The mud motor-powered, battery and electric motor type BHA, on the other hand, is capable of continuous drilling operation, which represents savings in terms of both the reduction of downtime as well as equipment cost. It is to be noted that the batteries used in downhole drilling operations, even those specifically designed for high pressure-high temperature environments, are inherently limited in life cycle, and have to be changed frequently. However, since these batteries are not the sole power, but only storing excess power, they are expected to last longer, plus we now have the ability to charge them downhole.

The combination of the mud motor and rechargeable battery pack where the mud motor is used to generate power to recharge the battery is a preferred embodiment. In this combination, rather than acting as the main source of power, the onboard Li-ion battery functions as an energy buffer. When the mud is flowing the battery is being charged. If the flow stops, such as when the drilling is halted to install additional drill pipes and/or carrying out a survey, the battery powers the MWD electronics. For example, a typical Li-ion battery can be used to support about 6 to 12 survey measurements between charges. This rechargeable battery can reduce or eliminate the need to withdraw an MWD tool, thereby reducing the interruptions in operation. The battery can also provide additional power when the power draw exceeds the power generated.

The following references are incorporated by reference in their entirety.

U.S. Pat. No. 9,115,540 Downhole adjustable mud motor.

U.S. Pat. No. 10,563,461 Hybrid drive for a fully rotating downhole tool.

U.S. Pat. No. 8,893,824 Steerable drilling system

U.S. Pat. No. 7,953,586 Method and system for designing bottom hole assembly configuration.

NOV Enhancing RSS Operations (Brochure), online at nov.com/-/media/nov/files/about/news/enhancing-rss-operations-with-agitator-system/oilfield-technology-0419.pdf drillingmanual.com/measurement-while-drilling-mwd-tool-oil-gas/

The invention claimed is:

1. An electrically driven bottom hole assembly (BHA) comprising:

a) a mud motor operatively coupled to an electric power generator, said electric power generator for converting hydraulic power from said mud motor to electrical power;

b) a power management system below said mud motor, said power management system electrically coupled to said electric power generator and comprising:
   i) a measure-while-drilling (MWD) sensor(s) operatively coupled to said BHA to measure drilling parameters and rock properties;
   ii) a drive shaft and a side force package for directional control of said drive shaft;
   iii) an electric drilling motor for driving a drill bit at a bottom end of said drive shaft; and
   iv) one or more optional temperature sensor or pressure sensor; and c) said electric drilling motor operatively connected to said drive shaft for rotating said drill bit, thereby decoupling drill bit speed from mud flow.

2. The BHA of claim 1, wherein said MWD sensor(s) are placed between said mud motor and said drill bit.

3. The BHA of claim 1, wherein said power management system comprises a processor, an electric transformer, a battery, or a combination thereof.

4. The BHA of claim 1, wherein said MWD sensor(s) are placed within 6 ft of said drill bit.

5. The BHA of claim 1, further comprising a rechargeable battery electrically coupled with said electric power generator, said electrical drilling motor and said MWD sensor(s).

6. The BHA of claim 1, further comprising a controller electrically coupled to said electrical drilling motor and said MWD sensor(s).

7. The BHA of claim 1, wherein said drive shaft is hollow to convey mud from said mud motor to said drill bit.

8. The BHA of claim 1, wherein said drill bit rotates by using electrical power generated by said electric power generator, and said mud motor operates simultaneously, using hydraulic power from flowing mud.

9. The BHA of claim 1, said side force package comprises a piston, and wherein said piston is actuated to adjust a bend angle of said drive shaft.

10. An electrically driven bottom hole assembly (BHA) comprising:

a) a drill bit at a bottom end of said BHA;

b) an electric drilling motor connected to a drive shaft and a drill bit orienting mechanism to create a bend in said drive shaft, said drive shaft operatively connected to said drill bit;

c) an at-bit bend sensor operatively coupled to said drill bit or drive shaft;

d) said drive shaft operatively connected to a drive shaft shock absorption sub unit;

e) a bearing pack to carry axial load located below, inside, or above said electric drilling motor;

f) measure-while-drilling (MWD) sensor(s) to measure drilling parameters and rock properties; and g) an electric power generator coupled to a mud motor for converting hydraulic energy to electric energy, said electric power generator capable of storing power in a power transfer tool, said power transfer tool electrically connected to said electric drilling motor, thereby decoupling drill bit speed from mud flow.

11. The BHA of claim 10, wherein said MWD sensor(s) are placed between said mud motor and said drill bit.

12. The BHA of claim 10, wherein said power transfer tool comprises an electric transformer or a battery or combinations thereof.

13. The BHA of claim 10, wherein said MWD sensor(s) are placed within 6 ft of said drill bit.

14. The BHA of claim 10, wherein said bearing pack is placed between said bit and said at-bit bend sensor.

15. The BHA of claim 10, wherein said drill bit and said mud motor can operate simultaneously or operate independently.

16. The BHA of claim 10, wherein said drill bit orienting mechanism further comprises a piston, and wherein said piston is actuated to adjust a bend angle of said drive shaft.

17. The BHA of claim 10, said power transfer tool comprising a rechargeable battery electrically coupled with the electric power generator and said MWD sensor(s).

18. A bottom hole assembly (BHA) for directional drilling, comprising:

a) a rotatory drill bit operatively connected to a drive shaft and one or more optional sensor(s);

b) said drive shaft operatively connected with a drive shaft orienting mechanism, a bearing pack, and a shock absorber;

c) an electric motor operatively coupled to said drive shaft;

d) measuring-while-drilling (MWD) sensor(s) and means for communication with a surface controller within 6 ft of said drill bit; and e) a mud motor above said MWD sensor(s) and said electric motor, said mud motor operatively coupled to an electric power generator and a rechargeable battery to convert hydraulic power to electricity for said electric motor to rotate said drill bit, thereby decoupling drill bit speed from mud flow.

19. The BHA of claim 18, wherein said drive shaft orienting mechanism comprises a piston for adjusting a bend angle of said drive shaft.

20. The BHA of claim 18, said rechargeable battery electrically coupled with said electric power generator and said MWD sensor(s).

* * * * *